US005391401A

United States Patent [19]

Blake et al.

[11] Patent Number: 5,391,401

[45] Date of Patent: Feb. 21, 1995

[54] COATING PROCESSES

[75] Inventors: Terence D. Blake, Tring; Rosemary Dobson, North Hykeham; Gregory N. Batts, Bushey; William J. Harrison, St. Albans, all of England

[73] Assignee: Eastman Kodak Company, Rochester, N.Y.

[21] Appl. No.: 78,280

[22] PCT Filed: Dec. 16, 1991

[86] PCT No.: PCT/EP91/02414

§ 371 Date: Jun. 17, 1993

§ 102(e) Date: Jun. 17, 1993

[87] PCT Pub. No.: WO92/11094

PCT Pub. Date: Jul. 9, 1992

[30] Foreign Application Priority Data

Dec. 20, 1990 [GB] United Kingdom ..... 9027676

[51] Int. Cl.[6] ..... B65D 1/30

[52] U.S. Cl. ..... 427/420; 427/407.1; 427/434.2; 427/439; 118/DIG. 4

[58] Field of Search ..... 427/420, 434.2, 439, 427/407.1; 118/D4

[56] References Cited

U.S. PATENT DOCUMENTS

| | | | |
|---|---|---|---|
| 2,761,791 | 9/1956 | Russell | 117/34 |
| 3,508,947 | 4/1970 | Hughes | 117/34 |
| 3,632,374 | 1/1972 | Greiller | 117/34 |
| 3,811,897 | 5/1974 | Babbit et al. | 96/114 |
| 3,867,901 | 2/1975 | Greiller | 118/50 |
| 4,001,024 | 1/1977 | Dittman et al. | 96/87 |
| 4,113,903 | 9/1978 | Choinski | 427/420 |
| 4,569,863 | 2/1986 | Koepke et al. | 427/402 |

FOREIGN PATENT DOCUMENTS

| | | |
|---|---|---|
| PCT/US90/-07559 | 7/1992 | WIPO . |

*Primary Examiner*—Samuel A. Acquah
*Attorney, Agent, or Firm*—Carl F. Ruoff

[57] ABSTRACT

In curtain coating, uniform layer or layers are only obtained if the operational variables are held within precise limits. These limits define a "coating window". However, one of the boundaries of this "window" is governed by the occurrence of air-entrainment. Described herein is an improved coating process in which allows the "coating window" to be enlarged. This is achieved by using a material adjacent the support on to which the liquid material is to be coated which readily shear-thins.

9 Claims, 17 Drawing Sheets

COATING PROCESSES

This invention relates to coating processes and is more particularly concerned with curtain coating processes.

Curtain coating processes are well-known and widely used for the application of one or more liquid layers on to the surface of a moving support. In particular, curtain coating may be used for coating photographic products.

Bead coating is the original method for the simultaneous coating of multiple layers, and its implementation led to highly efficient manufacture of photographic films and papers.

U.S. Pat. No. 2,761,791 discloses a bead coating method in which a low viscosity bottom layer is required to wet the support at high coating speeds. It is preferable that the bottom layer be relatively thick, to achieve the high degree of coating uniformity usually required in photographic products. Bottom layers having viscosity from about 3 to 10 mPas and wet thickness from about 40 to 100 μm are disclosed in U.S. Pat. No. 4,001,024.

However, the combination of a relatively thick and low viscosity bottom layer can be inconsistent with the requirements of the product, and can also result in a high load on the drier thereby restricting manufacturing speeds. Even with a relatively thick and low viscosity bottom layer, it is still generally necessary, in order to stabilize the bead, to apply at least a small pressure difference or suction across the bead, of the order of 1 cm of water, and to maintain a small gap, of the order of 300 μm, between the lip of the hopper and the support.

As a result, complex apparatus is required to produce and control a smooth suction in contact with the bead.

Moreover, producing and maintaining an accurate small gap between the hopper lip and the support is difficult and expensive. With so small a gap between hopper lip and support, bubbles and debris can become trapped under or on the lip, producing line and streak non-uniformities in the coating. Bubbles can be generated at coating starts and at splices, for example, and debris can be brought in on the surface of the support, or even as an imperfection of the support surface itself.

U.S. Pat. No. 4,001,024 discloses a bead coating method in which the limitations and disadvantages of bead coating methods are mitigated. The bead coating method described in U.S. Pat. No. 4,001,024 employs a thin, low viscosity bottom layer, with a sufficiently thick layer above the bottom layer which has a higher viscosity. For best results, the compositions of the bottom two layers should be such that some mutual displacement or intermixing of the bottom two layers can be tolerated. Bottom layers with viscosity from about 1 to 8 mPas and with wet thickness from about 2 to 12 μm, and a layer above the bottom layer with viscosity from about 10 to 100 mPas and wet coverage from 15 to 50 μm, are contemplated. Though drying loads can often be reduced in this manner, restrictions due to the need for uniformity of the bottom layer may still be encountered.

U.S. Pat. No. 4,113,903 discloses the use of a thin, pseudoplastic bottom layer in bead coating. The viscosity of the bottom layer is low, less than about 10 mPas, at the wetting line where shearing rates are high. This is to assist the dynamic wetting of the support. The bottom layer is also such that its viscosity is higher at the lower rates of shearing in the coating bead, away from the wetting line. The higher viscosity in the bead strengthens it, so that a larger gap between the lip and support can be used. Higher suctions, up to 25 cm of water, may be required to stabilize such a bead. The disadvantages of this method include the need to produce a high suction in contact with the bead, and the need for a small gap between the hopper lip and support. As described in U.S. Pat. No. 4,001,024, restrictions around the uniformity of the thin bottom layer can still be encountered.

The major disadvantages of bead coating methods were largely alleviated or solved by curtain coating methods. One method is described in U.S. Pat. No. 3,632,374.

In U.S. Pat. No. 3,632,374, a support is coated by forming a freely-falling vertical curtain of liquid so that it impinges on to the support. The curtain is stable and has a uniform flow rate across its width. A controlled relationship is maintained between the flow rate of the liquid and the speed at which the support is moved so that a thin layer, of specified thickness, of the coating liquid is formed on the support. Apparatus for forming the curtain include a hopper having a downwardly inclined slide surface over which the coating liquid flows by gravity until it reaches a lip. The lip is spaced vertically above the moving support and the coating liquid flows downwards in a freely-falling curtain from the lip.

Another method is described in U.S. Pat. No. 3,867,901 in which single layers are coated on to a support. U.S. Pat. No. 3,508,947 discloses a method for coating multiple layers on to a support.

Low bottom layer viscosities are not required to achieve high coating speeds, and the bottom layer does not have to be relatively thick to achieve good coating uniformity. The gap between the hopper lip and the support is of the order of centimeters, solving the problems associated with the small gap in bead coating. Furthermore, momentum is developed in the curtain during free fall between the hopper lip and the support, which assists the wetting of the support and the production of uniform layers. As a result, it is not necessary to apply a suction as in bead coating.

As manufacturing speeds progressively increase, the speeds achievable in curtain coating, as described in U.S. Pat. No. 3,867,901 and U.S. Pat. No. 3,508,947, may become limiting. The major limitation is the entrainment of air between the coating and support, which occurs when support speed is sufficiently increased.

Another disadvantage of known curtain coating methods is that air-entrainment may exhibit a "hysteresis" effect. As coating speed is increased at fixed layer flow rates, or at fixed layer wet thicknesses, air-entrainment eventually begins. As coating is speed is then decreased, it is found that the speed at which the air-entrainment ceases can be substantially below that at which it starts. A speed difference of 200 $cms^{-1}$ or more is not unusual. Thus, in a curtain coating process, there may be states where, depending upon the history of the process, air-entrainment may or may not occur. These states define a metastable region where it is not possible to predict whether there will be air-entrainment or not. In this metastable region, the passage of a splice can be enough of a disturbance to precipitate air-entrainment when none had previously existed. Imperfections in the support, such as abrasions, can similarly precipitate air-entrainment, as can transient disturbances encountered at the start of a coating. Good practice dictates that curtain coating within the metastable region is to be avoided. Thus coating speed may be undesirably limited, and appropriate means for identifying conditions which affect the production of air-entrainment must be identified and carried out.

U.S. Pat. No. 4,569,863 discloses the use of a thin, low viscosity bottom layer to increase speeds. A bottom layer with a viscosity ranging from 1 to 20 mPas, and a wet thickness of 2 to 30 μm, is contemplated. There are several possible disadvantages to this method. Such a thin layer would not in general be a functional layer in a product, and so a separate composition pumping system, together with a hopper with an additional slot would usually be necessary.

It is also difficult to deliver a low viscosity and relatively low flow rate layer down an inclined hopper slide as a bottom layer without waves and other manifestations of unstable flow. U.S. Pat. No. 4,569,863 also describes a V-shaped hopper, wherein the low viscosity bottom layer is delivered down a separate slide which joins the main hopper slide on which is flowing the other layer compositions at the hopper lip. This results in a long main slide, which is undesirable since waves and other manifestations of unstable flow on the slide grow very rapidly as slide length is increased, and undesirable restrictions on the relative flow rates and viscosities of the layers on the main slide may result.

Certain geometric features of the hopper design can mitigate the slide instabilities which can accompany the delivery of a bottom layer, of relatively low viscosity and flow rate, on a slide surface. The angle of the slot-containing portion of the slide surface, termed the main slide surface, with respect to the horizontal can be minimized to stabilize the flow, for example, inclinations in the range of 5° to 20°. The total length of the slide surface can also be minimized by constructing hopper elements which are no thicker than required for the distribution cavities and for mechanical integrity, and by restricting the number of elements of which the hopper is comprised. In the case of a bottom layer which is relatively low in viscosity and flow rate, it is particularly important to minimize slide inclination and the total length of the slide surface over which this bottom layer flows. In particular, it is important to consider the slide surface of the hopper lip element. On this latter element is accomplished the transition from the main slide surface, which is preferably low in inclination and upward facing, to the beginning of the substantially vertical, free-falling curtain.

The lip element will generally have a slide surface portion which is a continuation of the main slide surface of low inclination and which continues a sufficient distance to project the hopper lip out past the main body of the hopper so that a freely-falling, substantially vertical curtain can be formed. A preferably smooth transition, as by rounding, is made between the main slide surface portion and the vertical or nearly vertical slide surface portion which terminates at the hopper lip. Lip elements can be produced with a main slide surface portion of the order of 5 cm, followed by a vertical or nearly vertical slide portion of the order of 2 cm.

Total slide length on the lip element can be reduced still further by substantially rounding the transition from the main slide surface portion to the vertical or nearly vertical slide surface portion, using a radius of curvature of the order of 2 cm. Alternatively, the transition may be achieved with a third planar slide surface portion of intermediate inclination, in the range of 40° to 70° to the horizontal, with the transitions between the three slide surface portions again preferably smooth. In this way, total slide length on the lip element can be reduced to the order of 5 cm, consisting of a main slide surface portion of the order of 4 cm, a slide portion of intermediate inclination of the order of 0.5 cm, and a vertical or nearly vertical slide portion of the order of 0.5 cm. A lip element can thereby be achieved which is satisfactory in all respects, including mechanical integrity, control of wetting line location on the hopper lip, and adequate clearance of the freely-falling curtain from the hopper body.

Using hopper designs as described above, restrictions on the choice of relative flow rates and viscosities of layers can be reduced, and, in particular, restrictions around the use of relatively low viscosity and flow rate bottom layers can be reduced.

When the low viscosity layer which wets the support is delivered using a V-hopper, it faces in a downward direction. Thus, the establishment of flow on such a slide can be difficult in practice, and dripping of composition off the slide surface may occur. Furthermore, with this slide orientation, there is a component of gravity normal to the slide surface which is de-stabilizing and promotes the growth of waves on the layer as it travels down the slide.

A low viscosity bottom layer also promotes "puddling" at the point where the freely-falling liquid curtain impinges on the moving support. A "heel" appears at the foot of the curtain. If the heel is sufficiently large, it may contain an eddy in which air bubbles and debris may become trapped, thereby generating a line or streak in the coating. A large heel can also oscillate, producing non-uniformities in the coating along and across the direction of support motion. To prevent puddling, the low viscosity bottom layer may have to be kept thin, even though a functional bottom layer may not be thin, and the curtain height low, though this adversely affects curtain stability and restricts the room beneath the hopper for other equipment, such as a start pan.

There are still other problems which can be encountered with a low viscosity bottom layer. Such a layer promotes flow after the coating point, due to support which may not be perfectly uniform in thickness, or due to air flows impinging on the coating before it solidifies. Low viscosity liquids are also more difficult to deliver in that they are generally poor for purging lines and auxiliary equipment such as mixers, pumps and de-bubbling devices of previously resident liquid (such as cleaning solution), air bubbles, and other slugs and debris as are encountered in practice. Such poor purging has been associated with an increased probability of coating non-uniformities, most notably lines and streaks.

In curtain coating, uniform layer or layers are only obtained if the operational variables are held within fairly precise limits. These limits define the so-called "coating window". It is to be noted that the "coating window" obtained is related to the liquid material which is to be coated on to the support.

As discussed above, one of the boundaries of the "coating window" is due to the occurrence of air-entrainment. For a liquid material having a particular viscosity, air-entrainment occurs at a coating speed which is related to the flow rate per unit width of the coating hopper. Therefore, for a given flow rate per unit width, an upper limit is imposed on the speed at which the liquid material can be coated on to a support.

It is therefore an object of the present invention to provide a curtain coating process in which at least the layer adjacent the support comprises material which, due to its physical properties, allow high coating speeds to be achieved thereby providing improved uniformity of the coating produced, and hence enlarging the "coating window".

According to one aspect of the present invention, there is provided a curtain coating process in which liquid material comprising one or more layers is coated on to a moving support, such that at least the layer of liquid material adjacent the support is a pseudoplastic liquid having a viscosity greater than 20 mPas at shear rates less than 500 $s^{-1}$, and a viscosity less than 10 mPas at shear rates greater than $10^6 s^{-1}$, characterized in that the viscosity of the pseudoplastic liquid approaches a substantially constant value at a shear rate which lies in a range between $10^4$ and $10^8 s^{-1}$.

In known curtain coating processes, such pseudoplastic materials as are employed, for example aqueous gelatin solutions, are not sufficiently shear-thinning to satisfy both these conditions simultaneously.

Advantageously, the viscosity of the pseudoplastic liquid attains a value of less than 10 mPas at shear rates between $10^4$ and $10^6 s^{-1}$ and a value between 0.5 and 10 mPas at the shear rates (typically greater than $10^6 s^{-1}$) found close to the wetting line. (The wetting line is the line defined by where the upstream side of the freely-falling liquid impinges on to the moving support.)

The substantially constant viscosity at the shear rates specified above leads to an unexpected elimination or substantial reduction in the metastable region produced due to the undesirable phenomenon of air-entrainment.

Furthermore, it is desirable that the pseudoplastic liquid has a rheological profile which exhibits a substantially constant viscosity at shear rates below 1000 $s^{-1}$. Advantageously, this viscosity should have a value between 30 and 200 mPas.

By having a substantially constant viscosity at shear rates of less than at least 500 $s^{-1}$, it is possible to ensure a high enough viscosity on the hopper slide such that waves and other manifestations of unstable flow on the hopper slide are not encountered. It also ensures a relatively high viscosity in the delivery lines, hopper distribution cavity, and auxilliary equipment so that purging is effective.

By using a pseudoplastic material as described above in curtain coating, the following advantages are obtained:

(1) improved coating uniformity;
(2) increased coating speeds without air-entrainment;
(3) reduction or elimination of the metastable region produced by the onset and clearance of air-entrainment; and thereby
(4) an enlarged "coating window".

It is unexpected that, by using a pseudoplastic liquid according to the present invention, the wetting of the support at high speed is promoted without encountering the problems associated with a low viscosity bottom layer.

It is also unexpected that the pseudoplastic bottom layer may be as thin as 1 μm and still accomplish the objective of increased coating speed without air-entrainment. However, this bottom layer is not restricted to being thin, and may be as thick as 100 μm or more. Thus, it is more likely that the bottom layer can be a functional layer in the product and not be present for the sole purpose of assisting the wetting of the support at high speed.

Furthermore, other layers coated above the bottom layer may be pseudoplastic or otherwise without detriment to the present invention.

The pseudoplastic materials according to the present invention may comprise either simple polymer solutions (e.g. aqueous poly(vinylpyrrolidone) (PVP)) or more complex systems such as relatively dilute gelatin melts containing polymeric thickeners (e.g. 5% aqueous gelatin plus 1% of a 20/80 copolymer of acrylamide and sodium 2-acrylamido-2-methylpropane sulphonate). Other materials may also be included for their properties, for example silver halide dispersions in photographic emulsions, or cross-linking agents.

For a better understanding of the invention, reference will made to the accompanying drawings in which:

FIG. 1 shows part of a coating map for a 15% aqueous gelatin solution (a shear-thinning liquid);

By "coating map" is meant a plot of coating speed, V ($cms^{-1}$), against flow rate per unit width, Q ($cm^2s^{-1}$), of the coating hopper.

By "application angle" is meant the slope angle of the support at the point of impingement of the freely-falling curtain and substantially vertical curtain, measured as a declination from the horizontal in the direction of coating.

In curtain-coating, the "coating window" can be conveniently represented by plotting a map of coating speed against flow rate per unit width as mentioned above. A line drawn through the origin of the map then connects all points having a constant wet thickness or lay-down, Q/V (cm). An example of such a map for a simple Newtonian (i.e. constant viscosity) liquid is shown at (a) in FIG. 1. This liquid is a 78% aqueous glycerol solution.

In this case, the curve portion labelled BCDE defines a air-entrainment boundary of the useful coating window for this liquid. All points below and to the right of the curve BCDE lie in a region in which air entrainment is experienced. The transition to air-entrainment occurs abruptly on crossing curve portion BCDE.

In general, the coating speed at the onset of air-entrainment depends on the viscosity of the liquid and usually the dependence is an inverse relationship, i.e. the lower the viscosity, the higher the coating speed. Very high coating speeds are achieved with viscosities in the range 1 to 10 mPas.

For shear-thinning liquids, such as the aqueous gelatin melts which may be used in the coating of photographic products, the coating map may be much more complicated than that shown at (a). For example, a coating map for a melt comprising 15% gelatin in water is shown at (b) in FIG. 1. The two coating maps (a) and (b) are shown on the same axes so that a comparison can easily be made.

Figure 1:
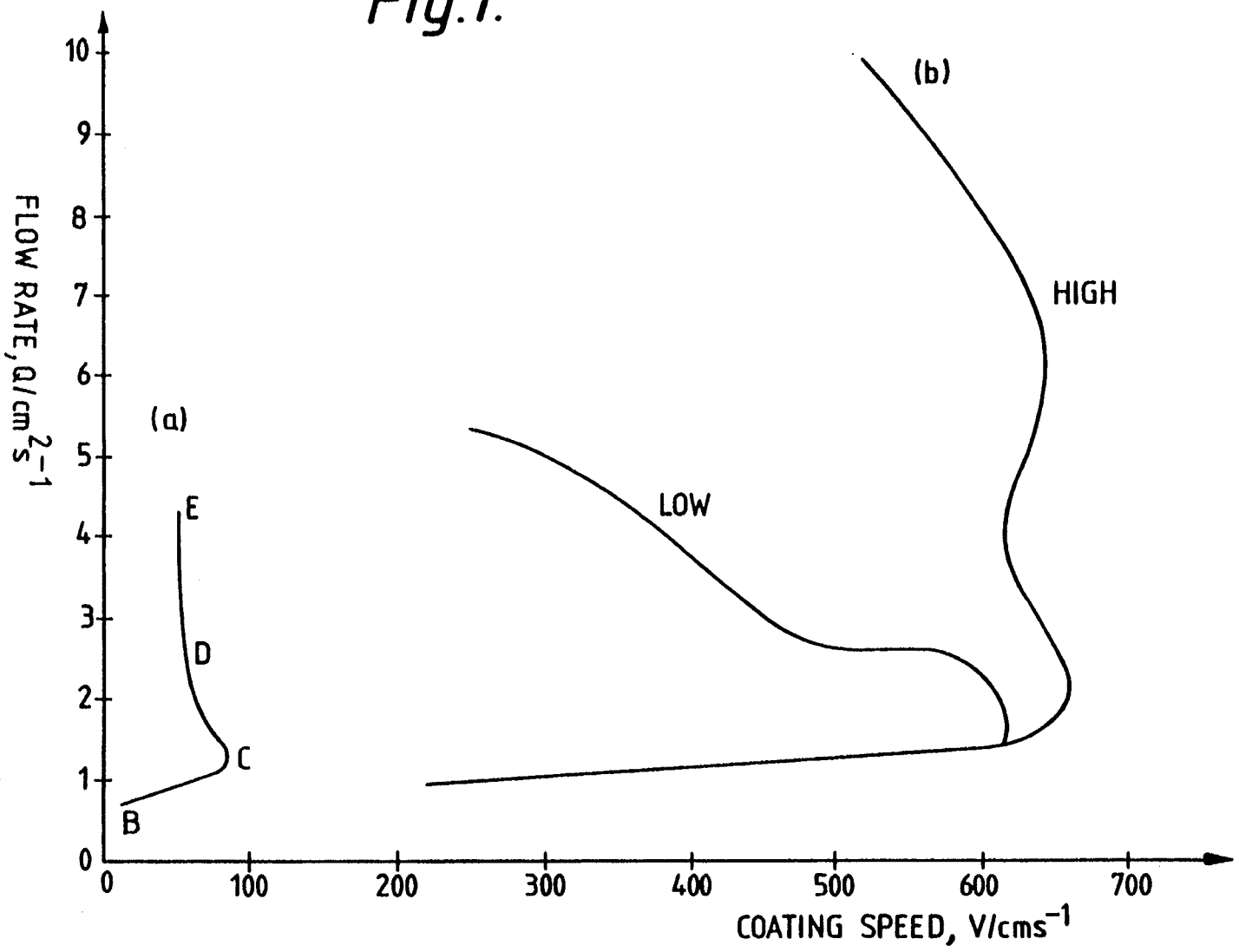
FIG. 1 shows part of a coating map for a 78% aqueous glycerol solution (a Newtonian liquid)

On comparing (a) and (b), two important differences are immediately apparent. The first is that although both the glycerol and gelatin solutions have comparable viscosities at low shear rates (50 mPas and 63 mPas respectively), the air-entrainment boundary is shifted to much higher speeds in the case of the gelatin solution. This is attributed to a reduction in viscosity caused by the very high shear rates close to the wetting line, which are believed to be in the order of $10^6$ $s^{-1}$ or greater. As shown in FIG. 1, the seven-fold increase in coating speed as shown at (b) suggests that the reduction in viscosity is substantial.

The second difference between the two maps (a) and (b) is that at flow rates above some critical value, the air-entrainment boundary for the gelatin melt divides into two to provide a high speed boundary at which air-entrainment commences on increasing the coating speed or flow rate, and a lower speed boundary at which air-entrainment ceases on lowering the coating speed or flow rate. As discussed above, the overall effect is to produce a metastable region in which coating is unpredictable with respect to air-entrainment. Thus, clean coating starts are difficult to achieve and air-entrainment may easily be triggered by a small disturbance such as the passage of a splice. Evidently, this metastable region may seriously restrict the useful coating window.

Experiments with a range of shear-thinning liquids have shown that although a significant metastable region due to air-entrainment is obtained for aqueous gelatin melts at commonly used concentrations and for aqueous solutions of some other polymers, such as 4% poly(vinyl alcohol) (PVA, 88% hydrolysed, average mol.wt. $125\times10^3$), the effect is not necessarily observed with all polymers. For example, the effect was found to be negligible with 5% aqueous solutions of PVP (average mol.wt. $7\times10^5$), Dextran (mol.wt. $5\text{–}40\times10^6$), and with 0.5% aqueous sodium 2-acrylamido-2-methylpropane sulphonate.

Figure 2:
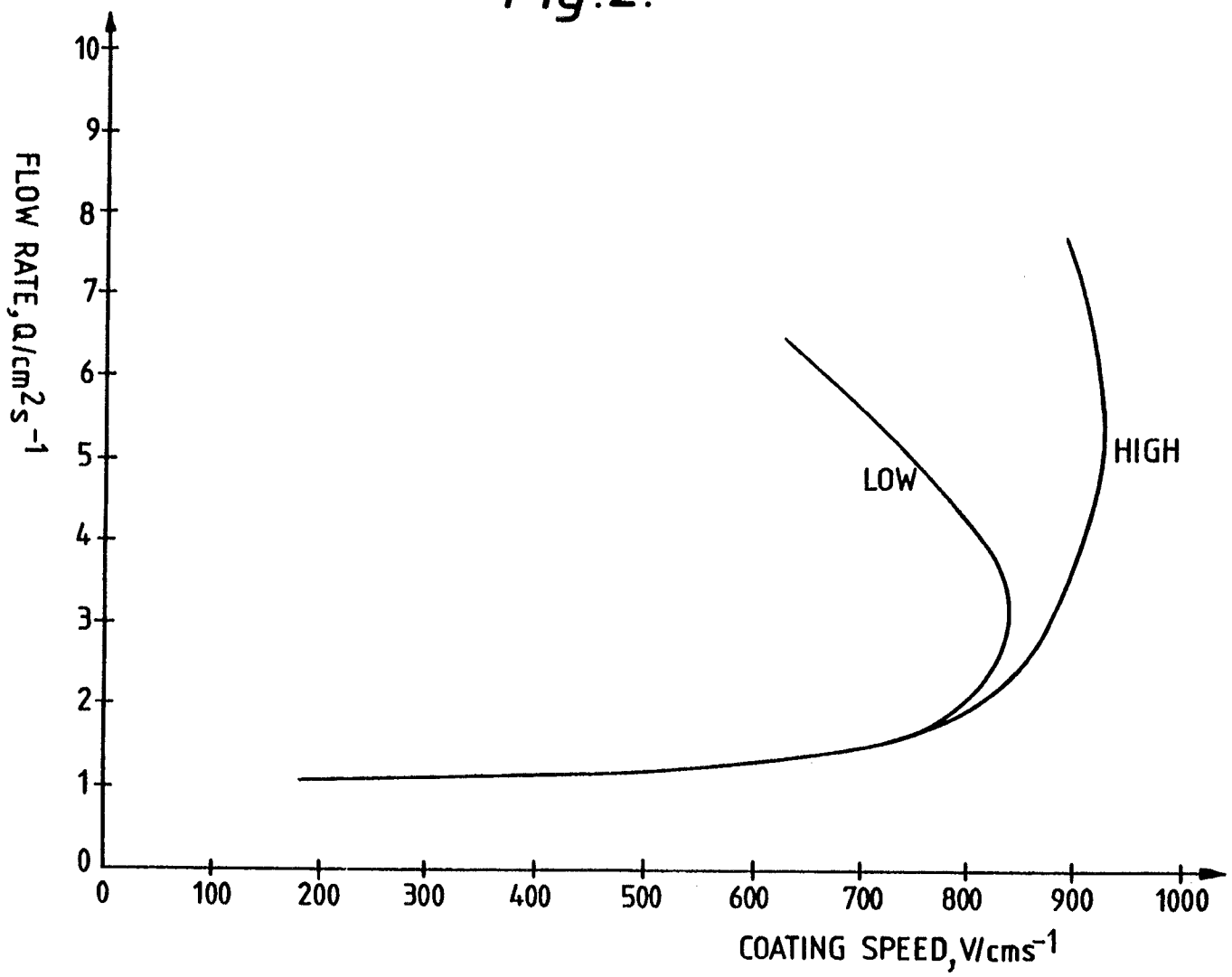
FIG. 2 shows part of a coating map similar to that shown in FIG. 1 but for a 5% aqueous gelatin solution.

For gelatin melts, the metastable region also becomes less prevalent as the gelatin concentration is reduced—an effect which may be correlated with the corresponding reduction in shear-thinning character. The reduction in the metastable region is illustrated in FIG. 2. The liquid for which the coating map is shown is 5% aqueous gelatin (compared with 15% aqueous gelatin shown at (b) in FIG. 1).

Overall, the results obtained for the liquids tested indicate that the metastable region produced by air-entrainment is due to the specific shear-thinning characteristics of the liquid that contacts the moving support. During coating, the shear rate near the wetting line, though always high, will vary with both wetting line position and flow conditions. If the liquid is shear-thinning over this range of shear rates, then there will be a corresponding variation in the local viscosity of the liquid. As disclosed in co-pending international patent application no. PCT/US90/07559, the highest coating speeds are achieved when the wetting line is located at some optimum position beneath the curtain. However, at the onset of air-entrainment, the wetting line moves sharply downstream and there is a drop in the local shear rate. If this leads to an increase in local viscosity, then the coating speed at which successful coating is possible will also fall because of the inverse speed/viscosity relationship discussed-above.

Furthermore, a substantial reduction in coating speed will be required to move the wetting line back to its initial position against the increased drag of the moving support. These two effects combine to ensure that the boundaries defining the onset and clearance of air-entrainment lie in different parts of the coating map.

Therefore, according to the above, the metastable region should be absent not only for Newtonian liquids, as is the case, but also for shear-thinning liquids which exhibit a second, constant viscosity plateau at the shear rates encountered near the wetting line.

It should be noted that the present invention as discussed herein is effective irrespective of whether or not the foregoing explanation of the metastable region is correct.

Figure 3:
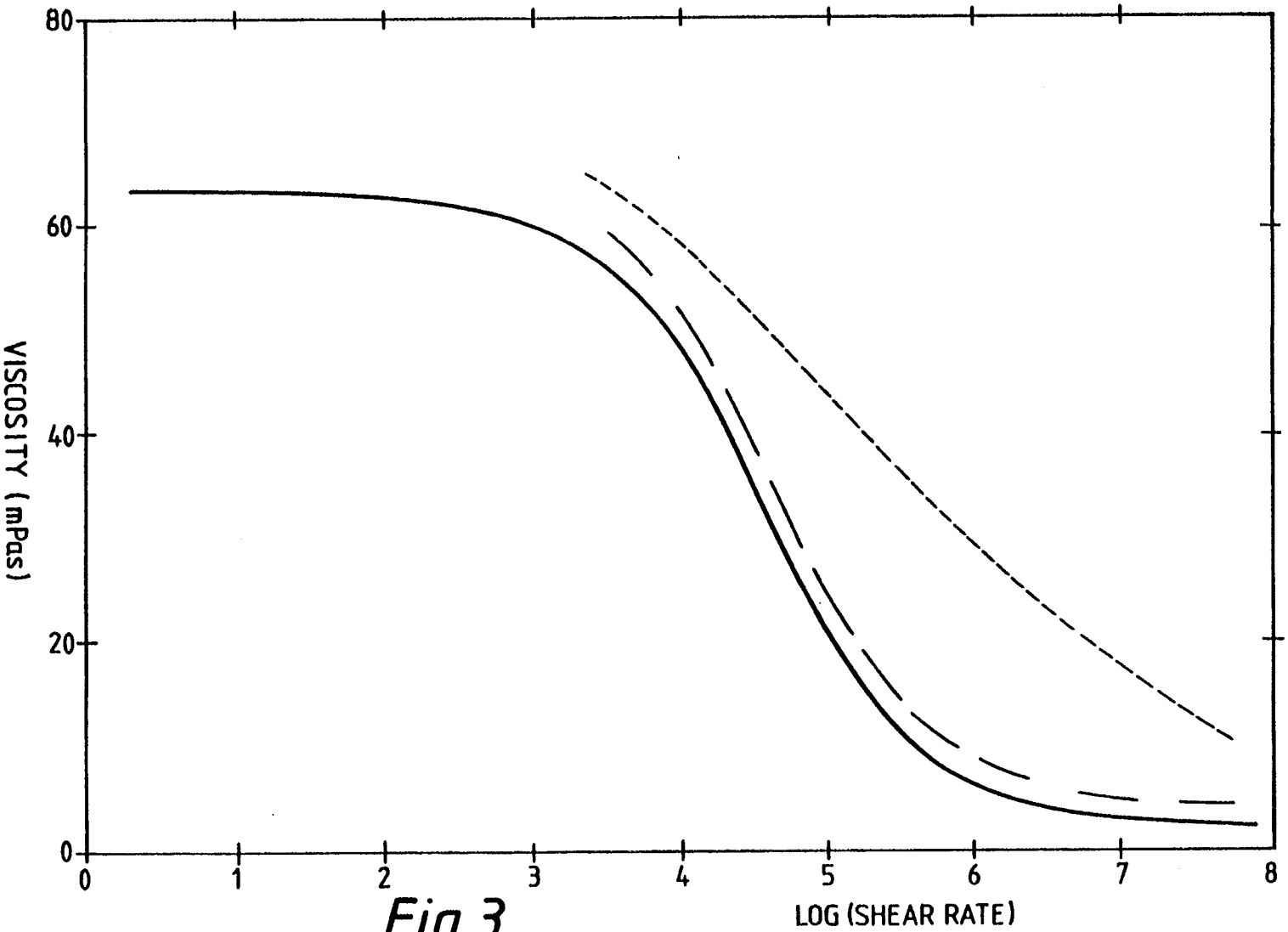
FIG. 3 shows schematic theological profiles for different types of liquids.

FIG. 3 illustrates schematic rheological profiles for different types of liquids. The broken line illustrates a liquid as discussed above, and the dotted line represents the situation for a liquid which shows a metastable region due to air-entrainment. In either case, the low viscosity at high shear rates ensures that air-entrainment is postponed until high coating speeds are reached. However, the metastable region is avoided only if the viscosity becomes essentially constant below a shear rate of approximately $10^8$ $s^{-1}$.

As discussed above, the viscosity of the coating liquid has a strong influence on the uniformity of the final coated layer. Liquids that have high viscosities on the hopper slide and on the moving support are less prone to instabilities and disturbances. Current practice indicates that the preferred viscosity range is from 30 to 200 mPas.

If the conditions for coating uniformity are combined with those required to promote wetting and minimise the metastable region due to air-entrainment, then we can establish the "optimum rheological profile" for a liquid to be used for curtain coating. A liquid having this profile will exhibit a high, but substantially constant viscosity at shear rates less than $10^3\ s^{-1}$, but will then shear-thin rapidly to a much lower, but substantially constant viscosity at shear rates less than $10^8\ s^{-1}$. Such a profile is indicated by the solid line in FIG. 3, and is consistent with the Carreau-Yasuda model of pseudoplastic liquids [R. B. Bird et al., "Dynamics of Polymeric Liquids," 2nd et, vol. 1, Wiley, N.Y., 1987].

Figure 4:
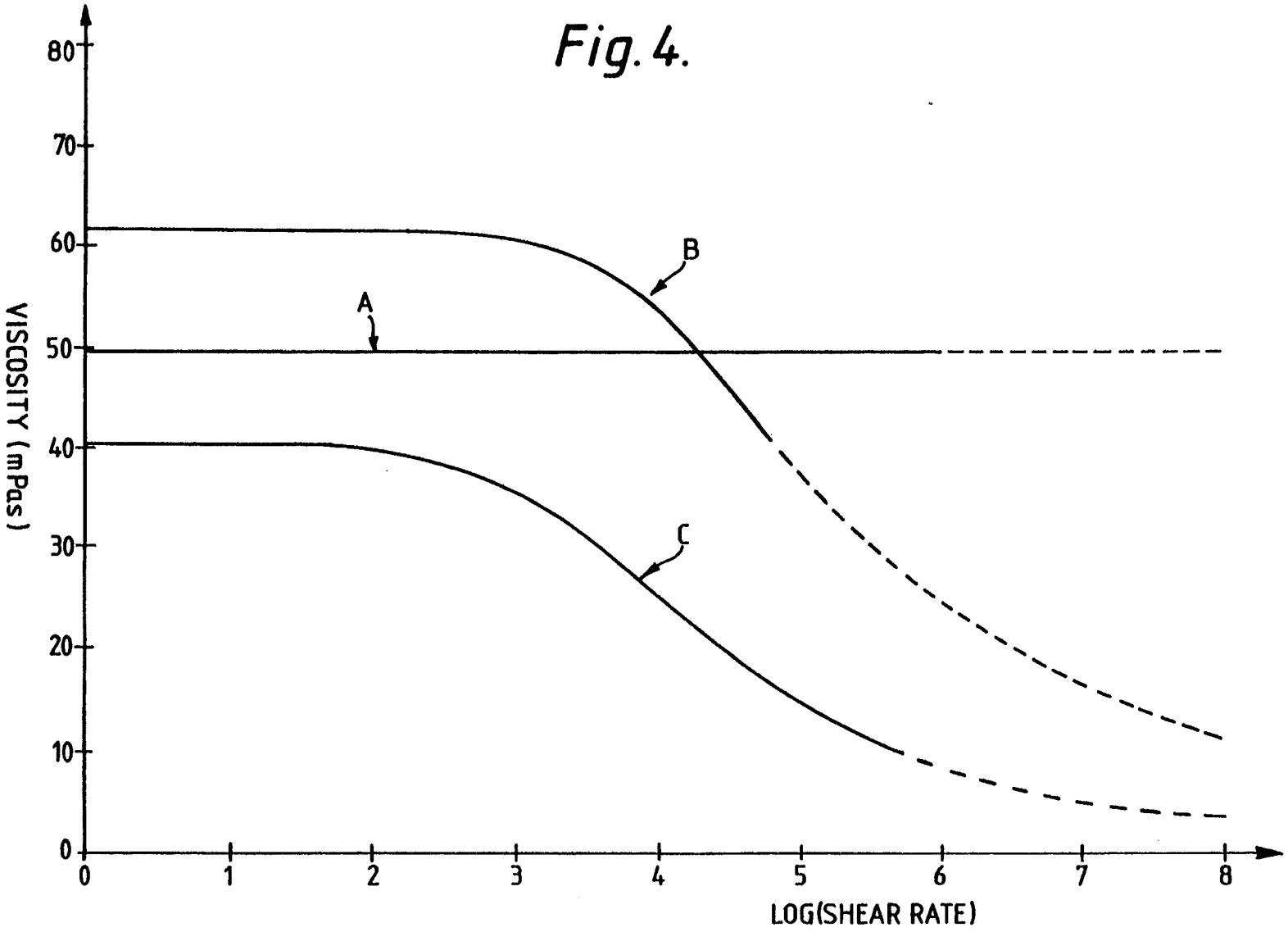
FIG. 4 shows measured rheological profiles for 78% glycerol, 15% gelatin and 5% poly(vinylpyrrolidone) aqueous solutions.

Measured profiles for aqueous solutions containing 78% glycerol, 15% gelatin, and 5% PVP are shown by respective solid lines (A), (B), and (C) in FIG. 4. At high shear rates, the profile for the gelatin (B) lies between that of the Newtonian liquid glycerol, shown as line (A) and the strongly shear-thinning PVP solution shown as line (C). Unfortunately it has not yet proved possible to measure the viscosities at shear rates in excess of $10^6\ s^{-1}$, so the behaviour at very high shear rates can only be inferred. In FIG. 4, the curves have been extrapolated (dotted lines) using estimates of the limiting high shear rate viscosity derived by comparing the maximum coating speeds with those found for Newtonian liquids. In any case, the limiting viscosity is expected to be somewhat greater than the viscosity of the solvent. However, until such extrapolations can be confirmed, selection of liquid compositions having the optimum rheology must be based on both rheological measurement and coating evaluation. Nevertheless, it should be evident from the foregoing discussion that simple power-law liquids (R. B. Bird, loc. cit, and U.S. Pat. No. 4,113,903) are unlikely to exhibit all the advantages of the present invention.

In co-pending international patent application no. PCT/EP91/02416, we show that very thin layers (e.g. less than 2 μm) of very low viscosity Newtonian liquids (e.g. water or aqueous solutions) can be used as bottom layers to promote wetting to such an extent that coating speeds of the order 1000 $cms^{-1}$ are possible even with very viscous upper layers (e.g. 15% gelatin melts). Similar benefits have also been shown for very thin pseudoplastic bottom layers comprising water and dilute solutions of polymers and certain gelatin/polymer combinations, specifically:

1) 0.5% sodium 2-acrylamido-2-methylpropane sulphonate (14 mPas at 42° C. and $10^6\ s^{-1}$);
2) 0.7% gelatin plus 0.22% sodium 2-acrylamido-2-methylpropane sulphonate (49 mPas at 40° C. and $10^6\ s^{-1}$);
3) 5% PVA (56 mPas at 41° C. and $10^6\ s^{-1}$); and
4) 6% PVP (39.7 mPas at 42° C. and $10^6\ s^{-1}$).

In each case, as in all the other examples described herein, the coatings were made on to gelatin-subbed ESTAR support (ESTAR is a registered trade mark of Eastman Kodak Company). Sample results are reproduced in the following table:

| bottom layer composition | bottom layer thickness (μm) | 15% gelatin upper layer thickness (μm) | maximum coating speed ($cms^{-1}$) | curtain height (cm) | application angle (°) |
|---|---|---|---|---|---|
| 1 | 1 | 94 | 958 | 12.7 | +20 |
| 2 | 1 | 80 | 844 | 12.7 | +20 |
| 3 | 4 | 113 | 833 | 12.7 | +20 |
| 4 | 1.1 | 81 | 870 | 25.4 | +45 |

Figure 5:
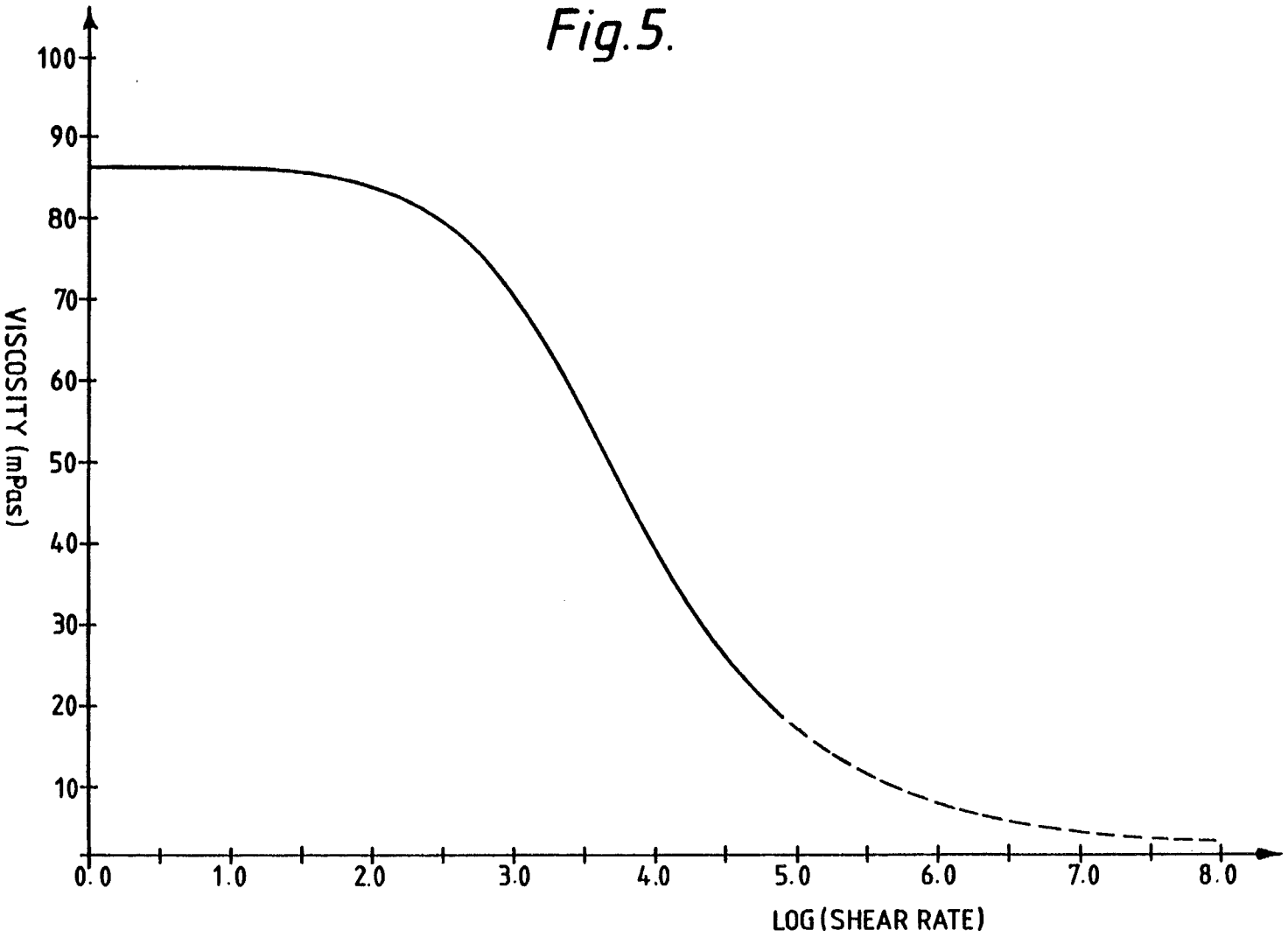
FIG. 5 shows the rheological profile for a 7.8% aqueous solution of PVP at 42° C.

Successful coatings have also been made at 42° C., using a 7.8% aqueous solution of PVP (BDH, Laboratory Reagent, average mol. wt. $7\times10^5$) as a bottom layer for a 15% aqueous gelatin melt. The rheological profile of the bottom layer is shown in FIG. 5. Although the viscosity is high (86 mPas) at very low shear rates, it begins to fall rapidly above about $5\times10^2\ s^{-1}$. Extrapolation suggests that the viscosity is approximately 7 mPas at $10^6\ s^{-1}$, that is, the viscosity is less than 10 mPas, as required.

Figure 6:
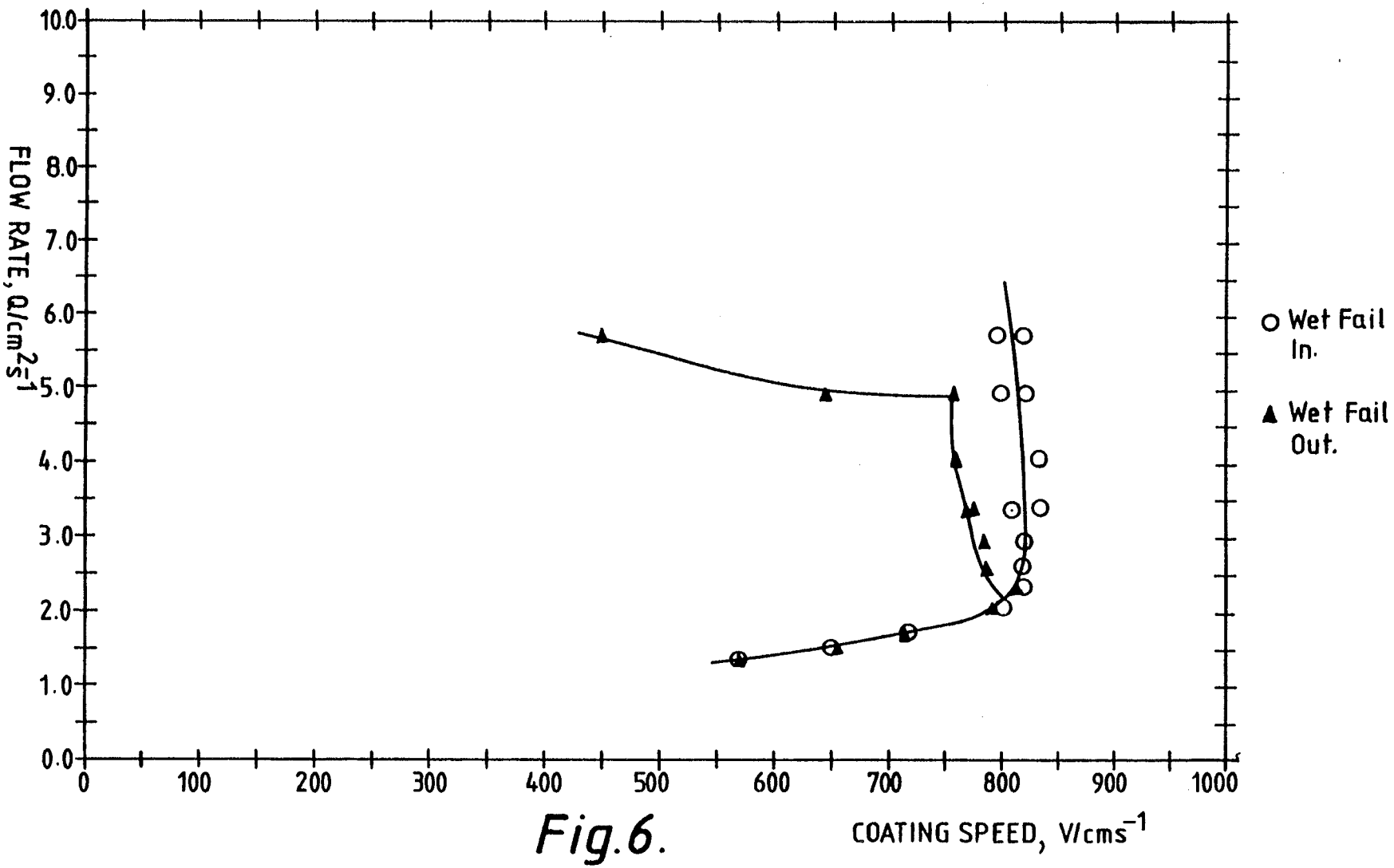
FIG. 6 shows part of a coating map for a 15% aqueous gelatin solution coated with a bottom layer of the solution having the rheological profile shown in FIG. 5, the bottom layer having a flow rate of 1.14 $cm^2s^{-1}$.
Figure 7:
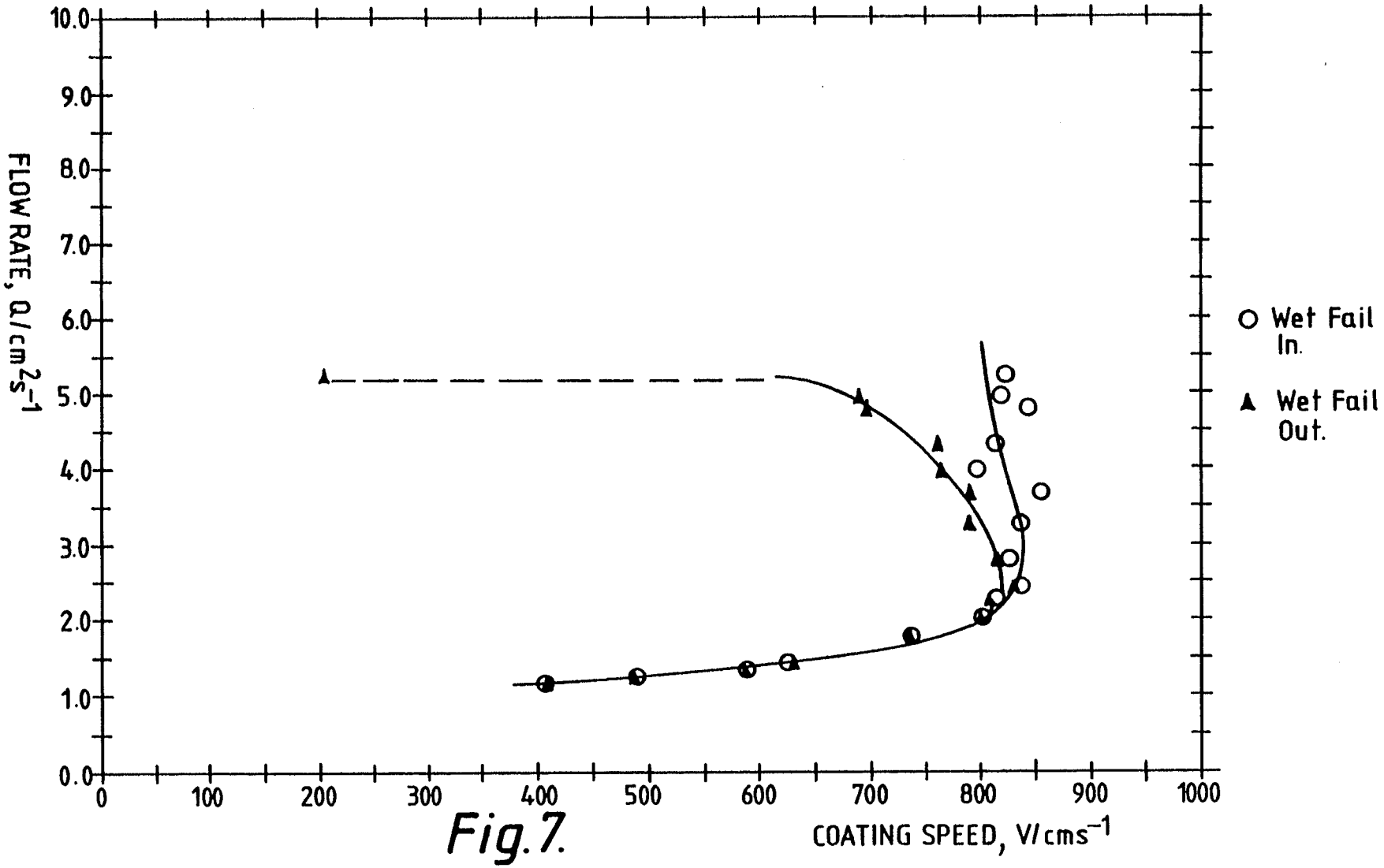
FIG. 7 shows part of a coating map for a 15% aqueous gelatin solution coated with a bottom layer of the solution having the rheological profile shown in FIG. 5, the bottom layer having a flow rate of 0.57 $cm^2s^{-1}$.
Figure 8:
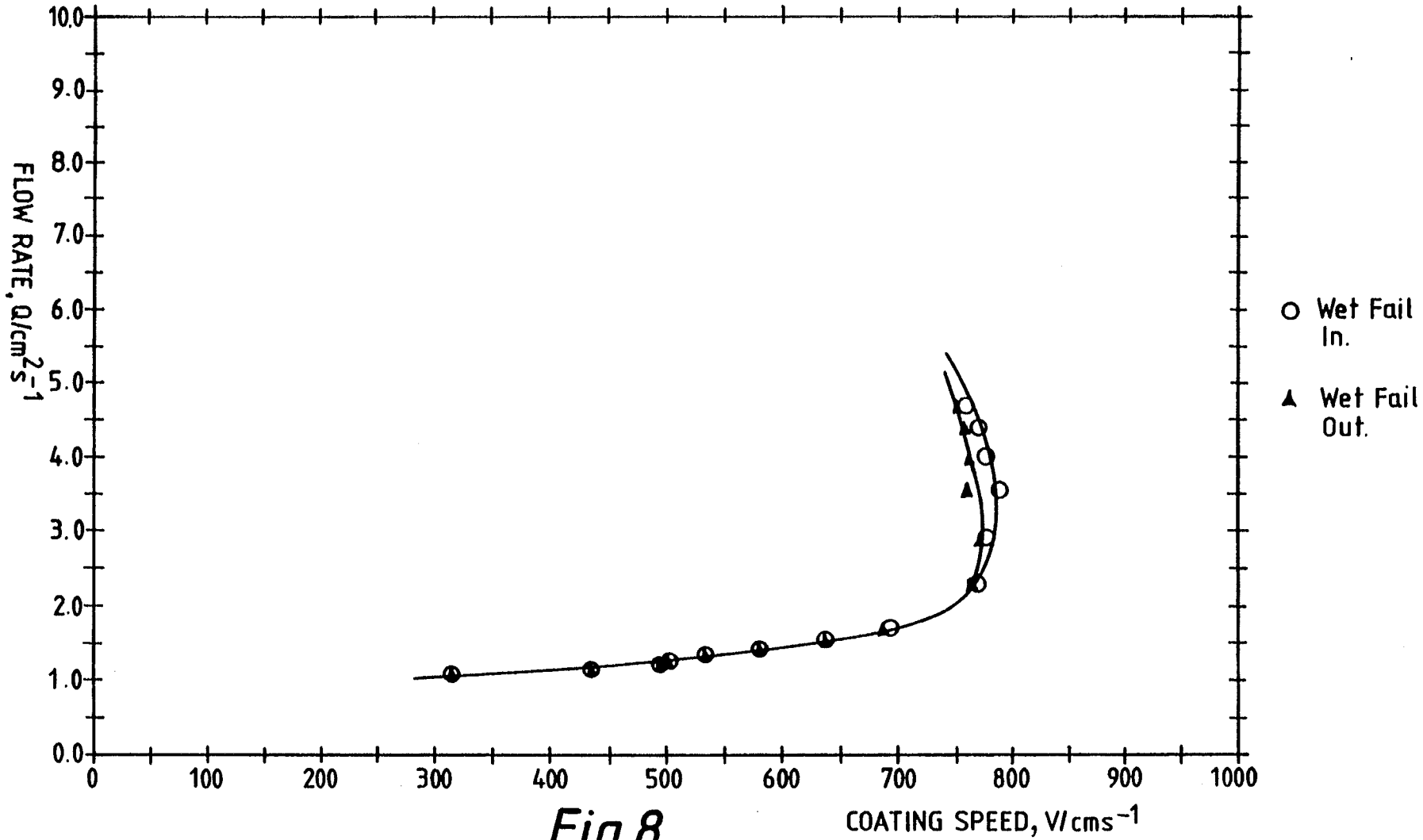
FIG. 8 shows part of a coating map for the solution having the rheological profile as shown in FIG. 5.

In the coating experiments, the flow rate of the bottom layer was fixed at either 1.14 or 0.57 $cm^2\ s^{-1}$ and the flow rate of the gelatin melt was varied to generate the coating map. The results and those for the PVP solution alone, are shown in FIGS. 6, 7 and 8 respectively. Evidently, the high coating speeds and negligible metastable region due to air-entrainment exhibited by the PVP solution are retained to a significant extent when this material is used as the bottom layer for a liquid which, by itself, would exhibit a lower coating speed and a large metastable region. For example, a comparison between curve (b) in FIG. 1 (see also FIG. 14, below) and FIGS. 6 and 7 shows that for a total wet laydown of 70 μm, the practical coating speed is increased by some 62%, from 420 to 680 $cms^{-1}$. In this case, at the onset of air-entrainment, the thinner bottom layer was still about 7 μm thick.

Figure 9:
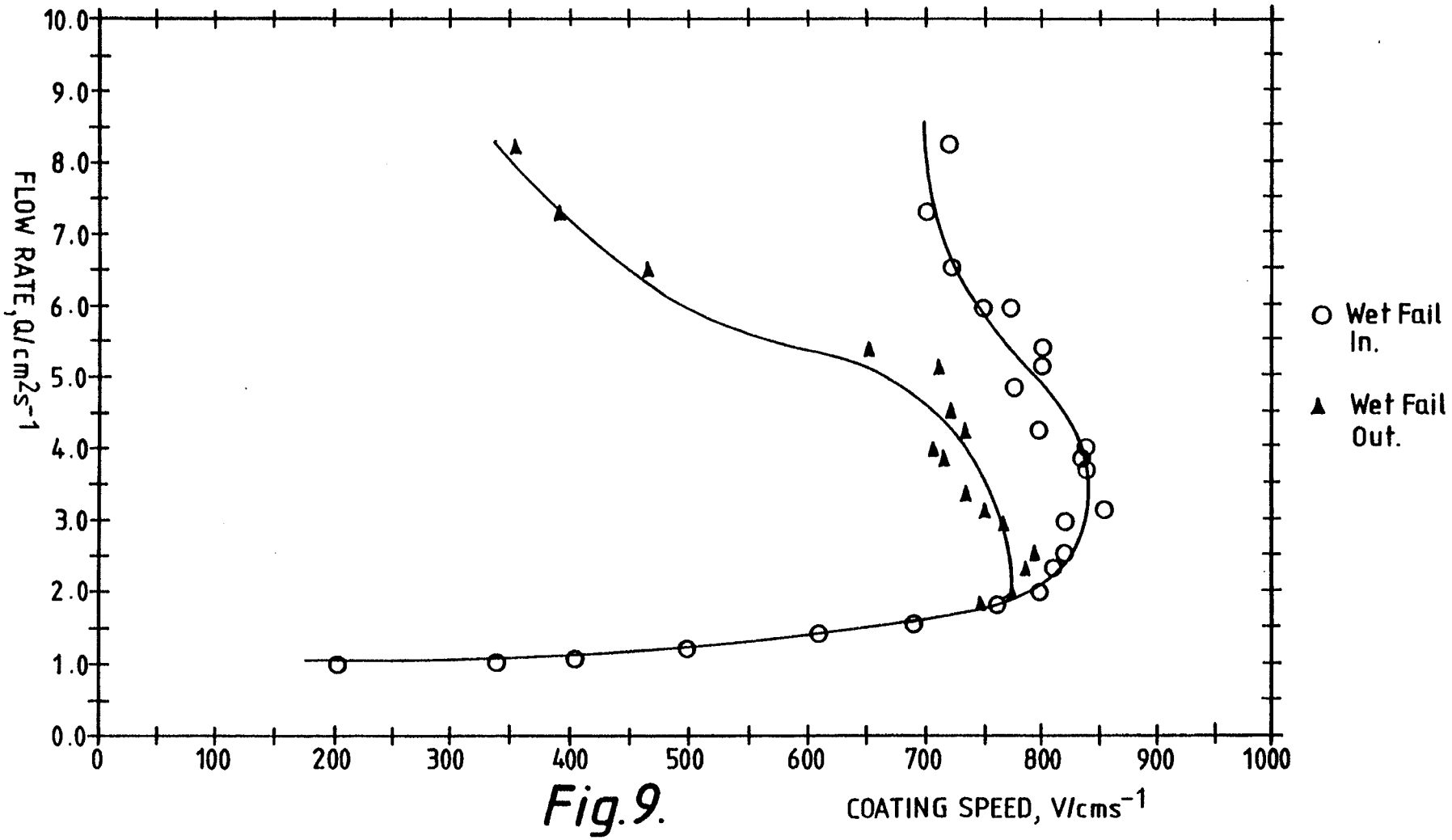
FIG. 9 shows part of a typical coating map for a 5% aqueous gelatin solution plus 1% of a 20/80 copolymer of acrylamide and sodium 2-acrylamido-2-methylpropane sulphonate.
Figure 10:
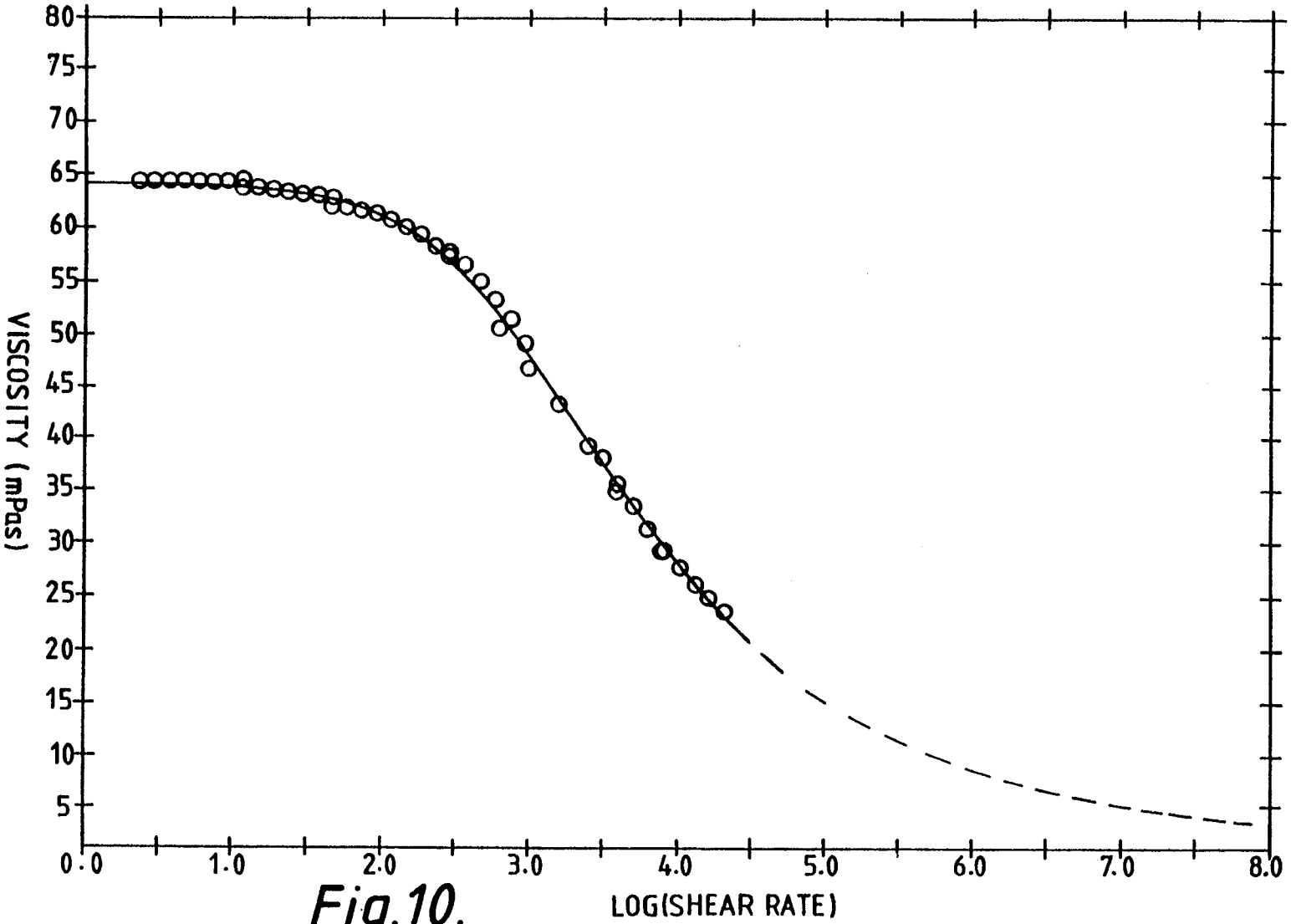
FIG. 10 shows the measured theological profile of the solution used to generate the coating map shown in FIG. 9.

Other experiments have shown that benefits can also be achieved by using polymeric thickeners to replace part of the gelatin in the bottom layer of a multi-layer coating. A typical coating map for 5% aqueous gelatin plus 1% of a 20/80 copolymer of acrylamide and sodium 2-acrylamido-2-methylpropane sulphonate is shown in FIG. 9. Although the metastable region produced by air-entrainment is not suppressed entirely, it is much reduced in comparison with a 15% gelatin melt, which has a similar viscosity at low shear rates. The overall coating speeds for the gelatin/copolymer system are also higher than those found for 15% gelatin, and compare well with those for 5% gelatin alone. Note however, that the 5% gelatin melt has a much lower viscosity at low shear rates and would therefore be less likely to yield a uniform coating. Thus, the gelatin/-polymer combination yields a theological profile (as shown in FIG. 10) that is much closer to the optimum than that of the 5% gelatin alone.

A specific preferred polymer/gelatin composition having superior coating performance in curtain coating will now be described. It has been shown that successful coatings can be made using an aqueous solution of 3% w/w deionised gelatin (Lot/Blend RD 863 ex Eastman Kodak Company) combined with 5.5% w/w PVP having an average molecular weight of 700,000. This solution was used as a bottom layer for a 15% w/w aqueous gelatin melt. The rheological profile obtained is shown in FIG. 11.

Experimental data (shown as circles) has been fitted to the Carreau-Yasuda model for shear-thinning liquids (R. B. Bird et al, vide supra). As before, the high shear rate extrapolation is based on an estimate of the limiting, high shear rate viscosity derived by comparing the maximum coating speeds observed for this system with those found for Newtonian liquids. The value arrived at was 1.4 mPas, which is just above the viscosity of the solvent (water).

In this example, use of the Carreau-Yasuda model was justified by the data, but in other examples, the data may show no sign of approaching a constant value at high shear rates. In such cases, the preferred first-order procedure is linear extrapolation of the power law region to the viscosity of the solvent (though of course the limiting viscosity will be somewhat higher).

Figure 11:
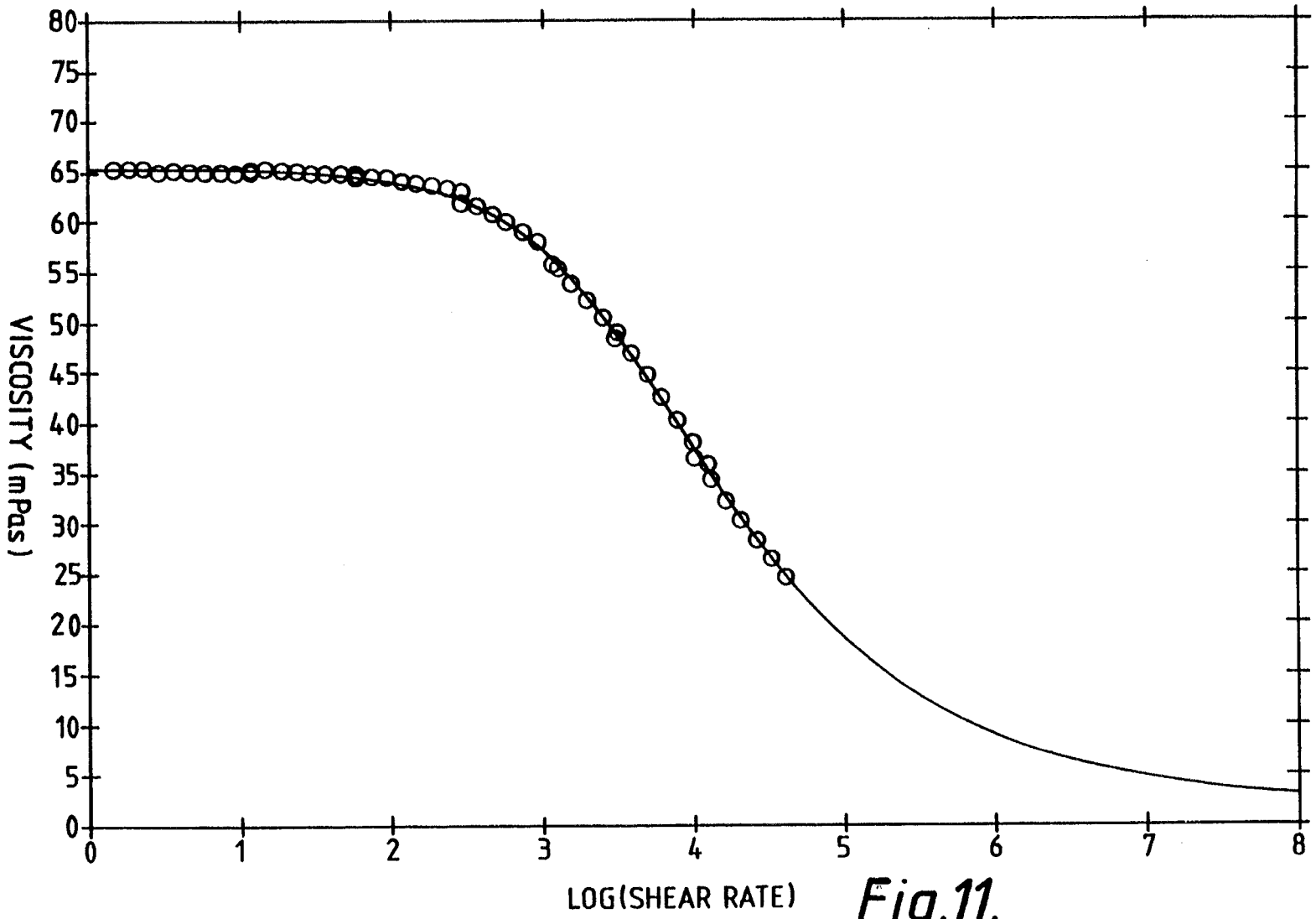
FIG. 11 shows the theological profile of a preferred polymer/gelatin composition.

For the data shown in FIG. 11, either procedure shows that in accordance with the present invention, the viscosity remains high (65 mPas) at relatively low shear rates (less than 100 $s^{-1}$, say), but begins to fall rapidly at shear rates above about 1000 $s^{-1}$, with a slope equivalent to a power law index of 0.64, and attains a viscosity of less than 10 mPas at a shear rate of $10^6 s^{-1}$. Comparable rheological profiles may also be obtained if the composition is varied slightly (e.g. to 5% w/w deionised gelatin plus 5% w/w PVP). Not all deionised gelatins are suitable. The compatability of PVP and gelatin is limited by salts present in the gelatin. Above some critical concentration of salts, PVP and gelatin phase-separate.

Figure 12:
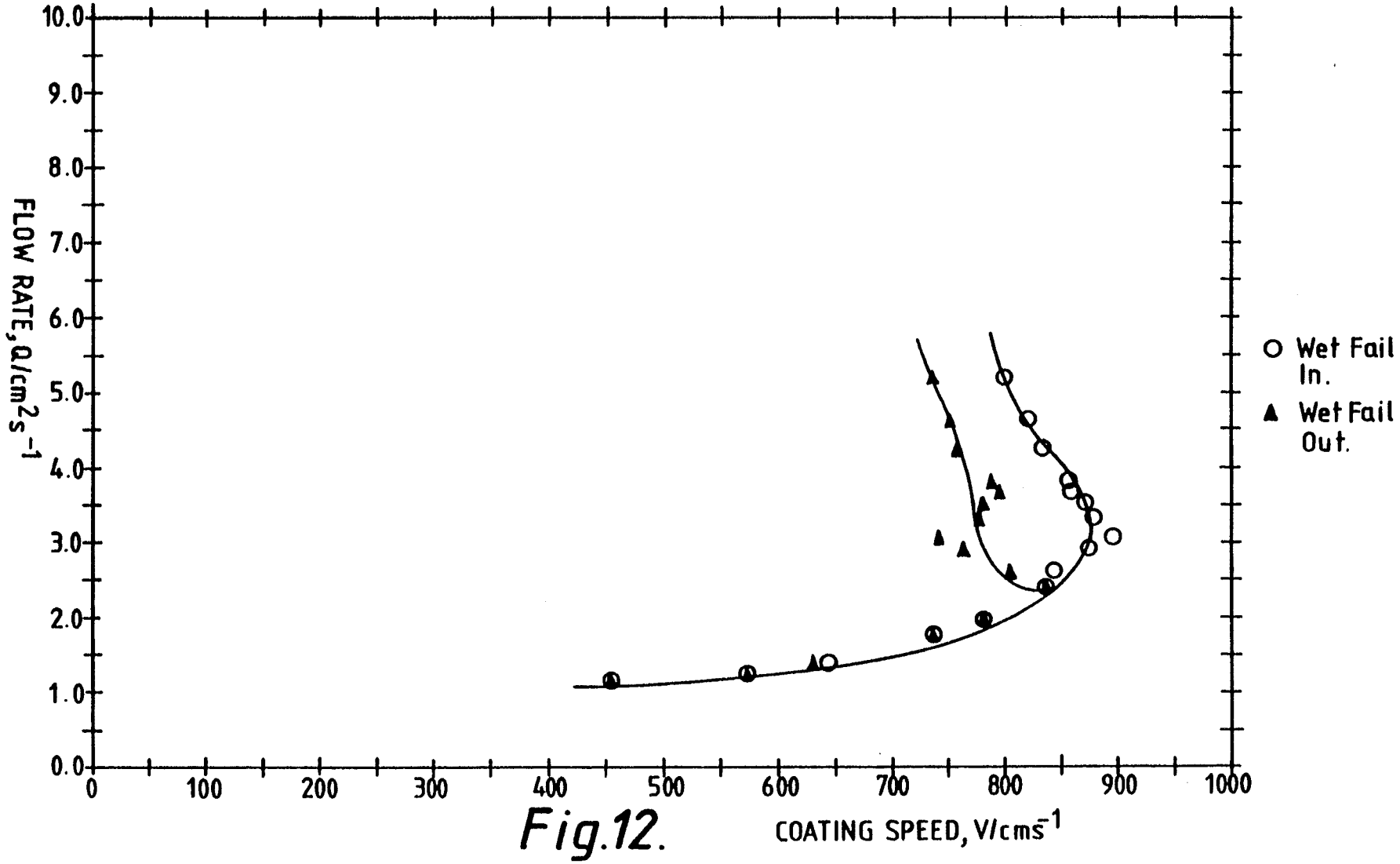
FIG. 12 shows part of a coating map for a 15% aqueous gelatin solution coated with a bottom layer of the preferred polymer/gelatin composition having the rheological profile shown in FIG. 11.
Figure 13:
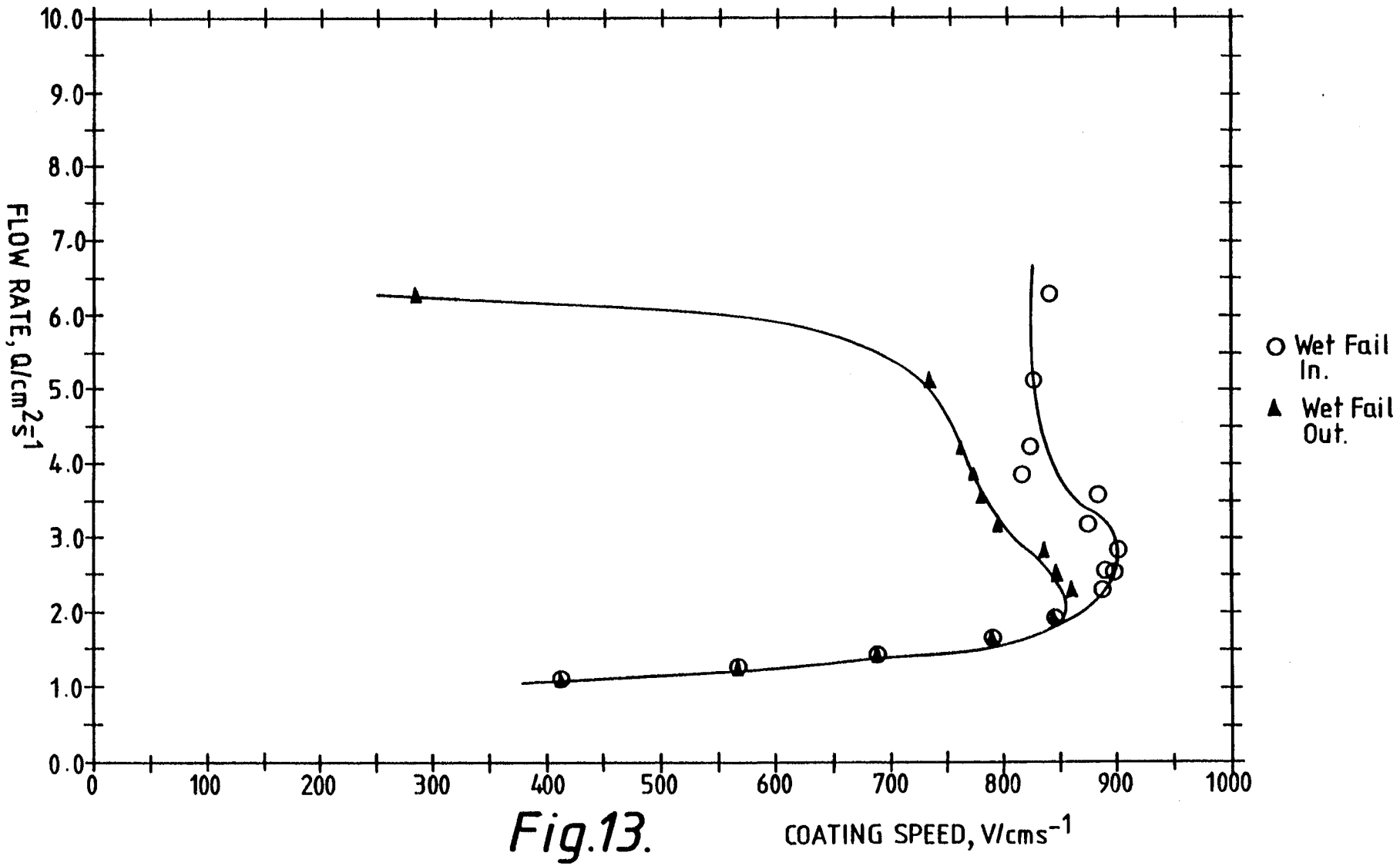
FIG. 13 shows part of a coating map for the preferred polymer/gelatin composition.

In the coating experiments carried out, the flow rate of the bottom layer was fixed at 0.57 $cm^2s^{-1}$, and the flow rate of the gelatin melt was varied to generate the coating map. The partial coating map for the bottom layer system is shown in FIG. 12, and that for the gelatin/PVP mixture alone in FIG. 13. These data were obtained with a curtain height of 10.2 cm, coating at an application angle of 0°, that is with a curtain perpendicular to the moving support.

Figure 14:
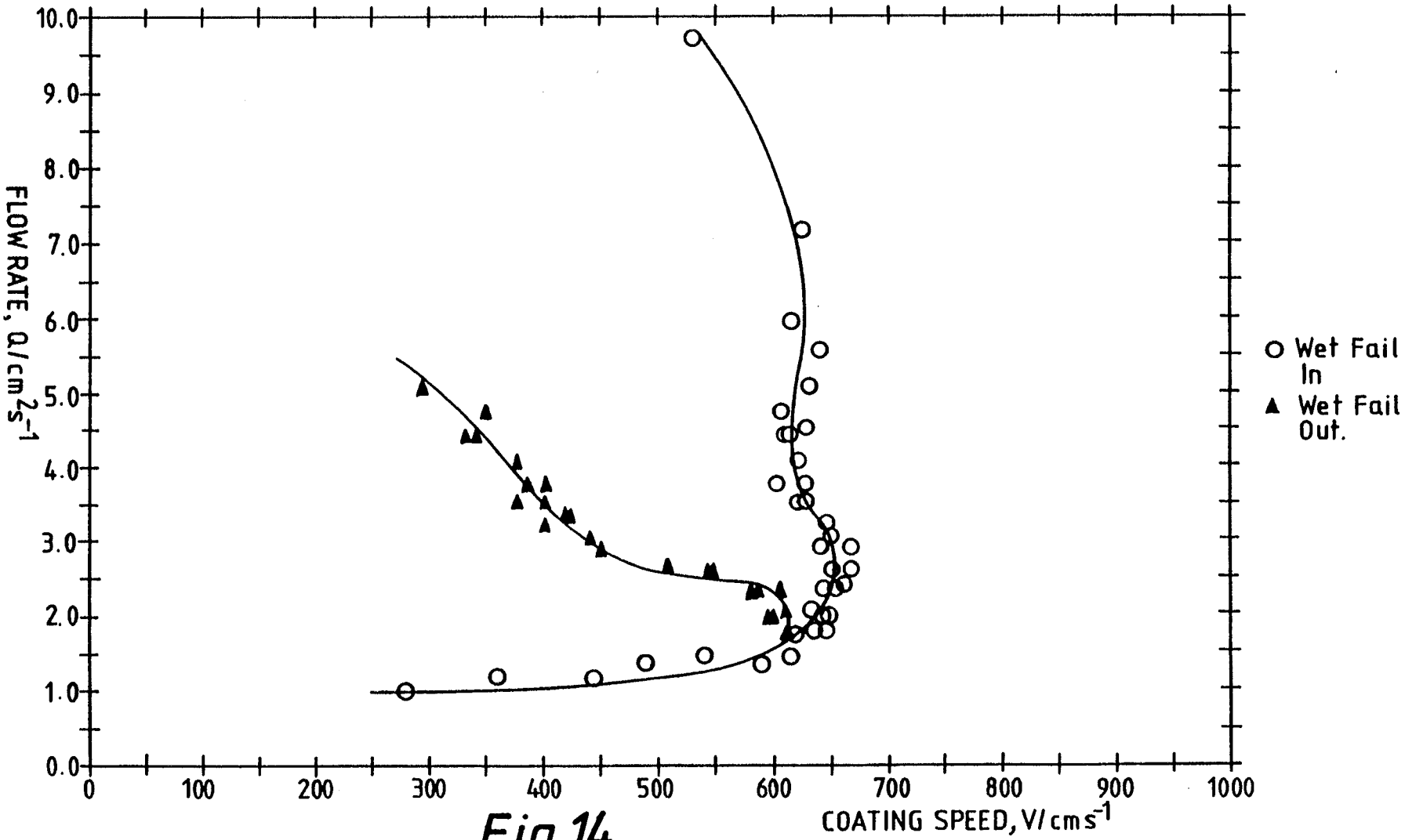
FIG. 14 shows part of a coating map for a 15% aqueous gelatin solution.

As observed for other polymer systems described previously, the high coating speeds and negligible metastable region formed by air-entrainment exhibited by the gelatin/PVP solution alone, are retained to a significant extent when this material is used as the bottom layer for a liquid which, by itself, exhibits a much lower coating speed and a large metastable region. For example, a comparison between FIGS. 12 and 14 shows that for a total wet laydown of 70 μm, the practical coating speed is increased by some 75% from 420 $cms^{-1}$ to 735 $cms^{-1}$. At the onset of air-entrainment, the bottom layer thickness was 6.5 μm.

Figure 15:
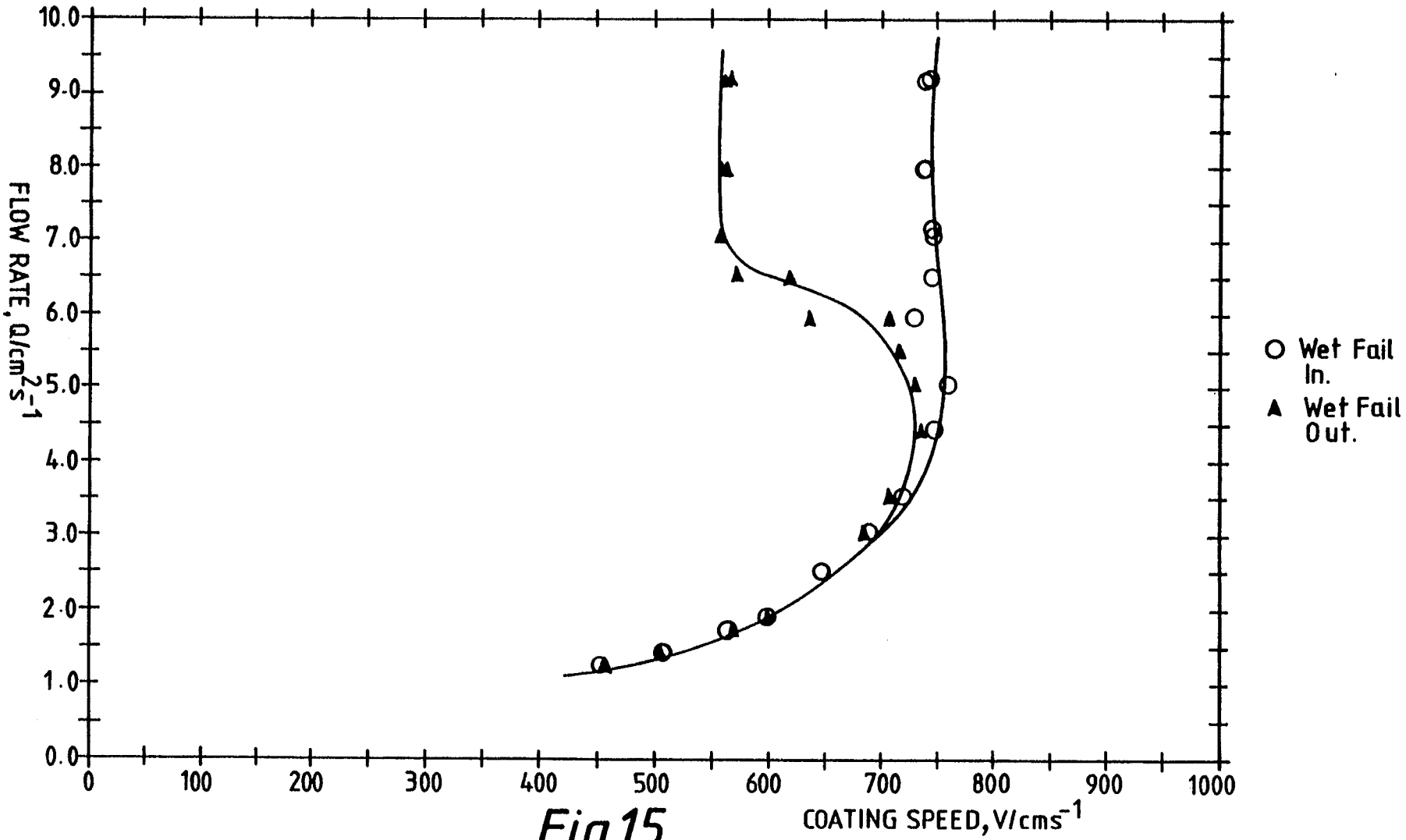
FIG. 15 shows part of a coating map for the solution shown in FIG. 14, but at an application angle of 45°.
Figure 16:
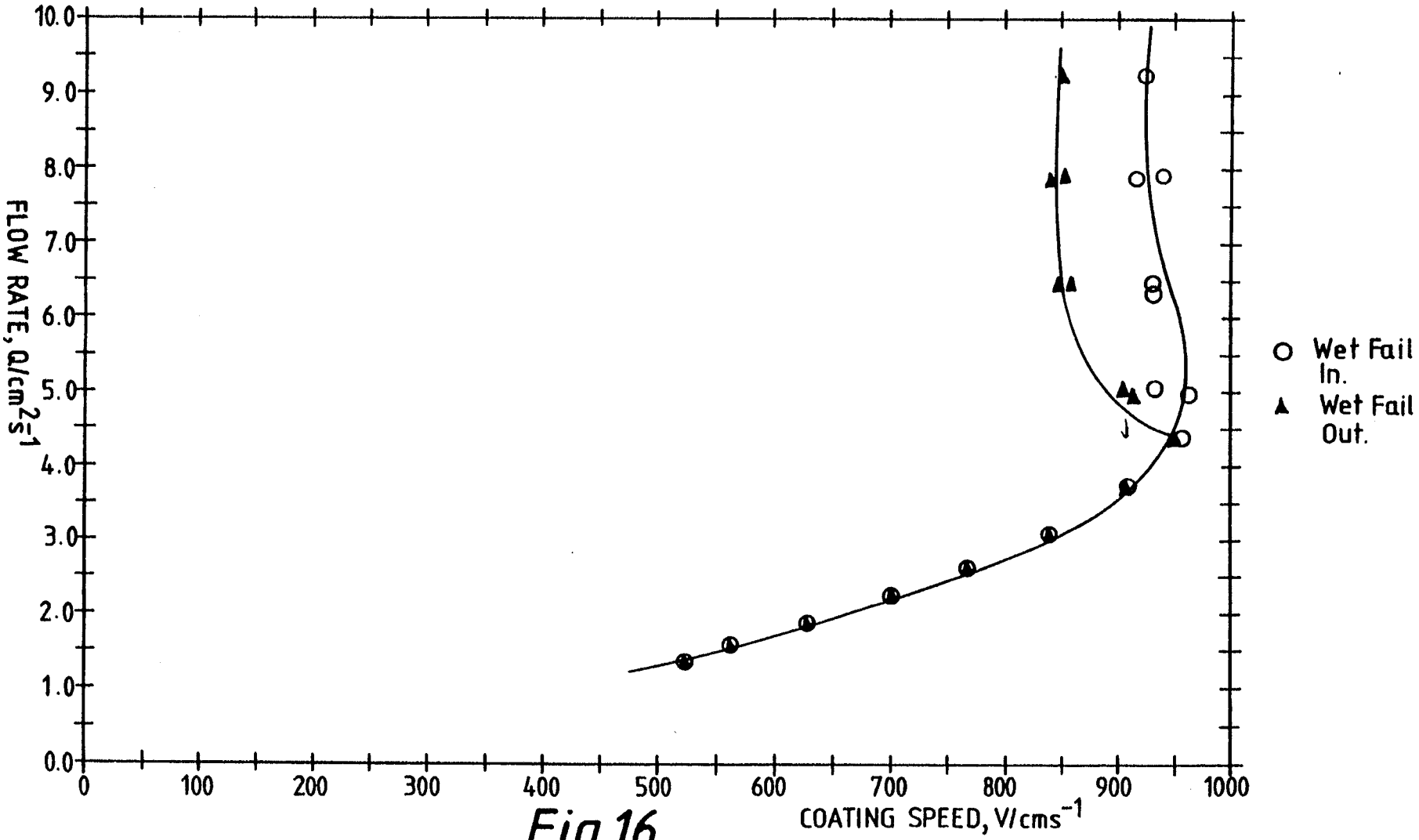
FIG. 16 shows part of a coating map for a 3% aqueous gelatin plus 5.5% PVP solution also at an application angle of 45°.
Figure 17:
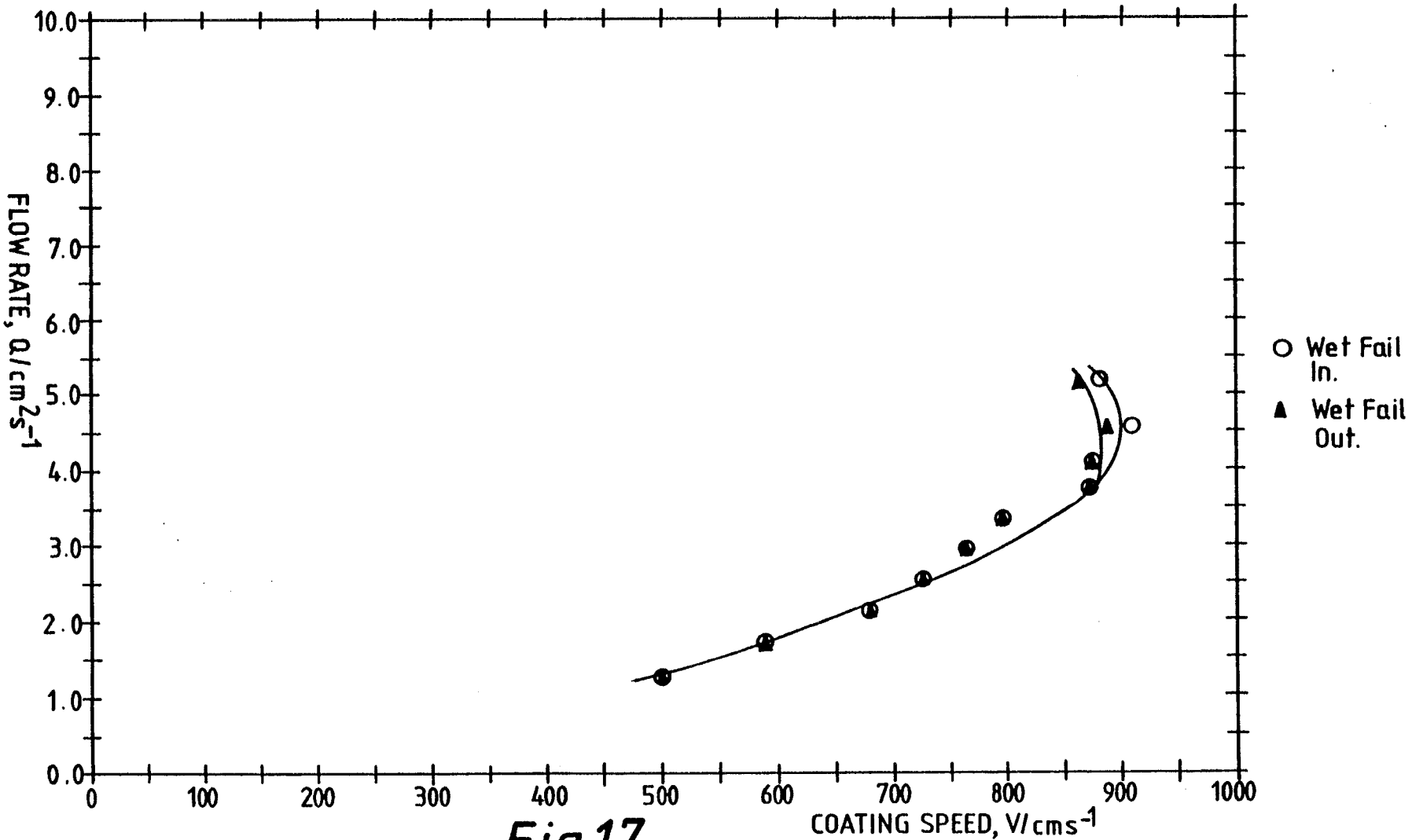
FIG. 17 shows part of a coating map for the FIG. 16 liquid when used as a bottom layer for a 15% aqueous gelatin solution at the same application angle.

As disclosed in co-pending international patent application no. PCT/US90/07559, high practical coating speeds may be obtained at curtain heights of 25.4 cm and application angles of +45°. Comparison of FIGS. 14 and 15 shows that these improvements lead to a reduction in the metastable region in the coating map. FIGS. 16 and 17 show that the benefits of using high curtains and forward application angles are enhanced by the practice of the present invention.

We claim:

1. A curtain coating process in which liquid material comprising one or more layers is coated on to a moving support, such that at least the layer of liquid material adjacent the support is a pseudoplastic liquid having viscosity greater than 20 mPas at shear rates less than 500 $s^{-1}$, and a viscosity of less than 10 mPas at shear rates greater than $10^6 s^{-1}$, characterized in that the viscosity of the pseudoplastic liquid approaches a substantially constant value at a shear rate which lies in a range between $10^4$ and $10^8 s^{-1}$.

2. A process according to claim 1, wherein the viscosity of the pseudoplastic liquid attains a viscosity of less than 10 mPas at shear rates between $10^4$ and $10^6 s^{-1}$.

3. A process according to claim 1, wherein the liquid has a viscosity between 0.5 and 10 mPas at shear rates between $10^4$ and $10^8 s^{-1}$.

4. A process according to claim 1, wherein two or more layers of the liquid are pseudoplastic.

5. A pseudoplastic liquid according to any one of claims 1 to 4.

6. A process according to claim 4, wherein the liquid has a viscosity between 30 and 200 mPas at shear rates less than 1000 $s^{-1}$.

7. A process according to claim 3, wherein the liquid has a viscosity between 0.5 and 10 mPas at shear rates between $10^4$ and $10^8 s^{-1}$.

8. A process according to claim 1, wherein two or more layers of the liquid are pseudoplastic.

9. A pseudoplastic liquid according to claim 2.

* * * * *

UNITED STATES PATENT AND TRADEMARK OFFICE

CERTIFICATE OF CORRECTION

PATENT NO. : 5,391,401

DATED : February 21, 1995

INVENTOR(S) : Terence D. Blake et al

It is certified that error appears in the above-indentified patent and that said Letters Patent is hereby corrected as shown below:

Column 12, lines 31-39, delete Claims 6-9.

Signed and Sealed this

Twenty-sixth Day of September, 1995

*Attest:*

Bruce Lehman

BRUCE LEHMAN

*Attesting Officer*

*Commissioner of Patents and Trademarks*